US007616116B2

(12) United States Patent
Ehrensvard et al.

(10) Patent No.: US 7,616,116 B2
(45) Date of Patent: Nov. 10, 2009

(54) ELECTRONIC TAMPER EVIDENT SEAL

(75) Inventors: Jakob Ehrensvard, Taby (SE); Fredrik Einberg, Huddinge (SE); Robert Debrody, Wayne, NJ (US); Richard Dreisbach, Andover Township, NJ (US); George Lundberg, Pompton Plains, NJ (US)

(73) Assignee: E. J. Brooks Company, Livingston, NJ (US)

( * ) Notice: Subject to any disclaimer, the term of this patent is extended or adjusted under 35 U.S.C. 154(b) by 387 days.

(21) Appl. No.: 11/559,221

(22) Filed: Nov. 13, 2006

(65) Prior Publication Data

US 2007/0120381 A1 May 31, 2007

Related U.S. Application Data

(60) Provisional application No. 60/597,174, filed on Nov. 15, 2005.

(51) Int. Cl.
*G08B 13/14* (2006.01)

(52) U.S. Cl. ..... 340/571; 340/568.1; 340/541; 340/542; 340/652

(58) Field of Classification Search ..... 340/571, 340/568.1, 541, 542, 652
See application file for complete search history.

(56) References Cited

U.S. PATENT DOCUMENTS 4,729,626 A 3/1988 Stieff
4,802,700 A 2/1989 Stevenson et al.
4,885,571 A 12/1989 Pauley et al.
5,005,883 A 4/1991 Guiler
5,298,884 A 3/1994 Gilmore et al.
5,347,689 A 9/1994 Georgopoulos et al.

(Continued)

FOREIGN PATENT DOCUMENTS

GB 2 233 803 1/1991

(Continued)

OTHER PUBLICATIONS

International Search report and Written Opinion ISA-EP Apr. 2, 2007.

(Continued)

*Primary Examiner*—Tai T Nguyen
(74) *Attorney, Agent, or Firm*—Carella, Byrne et al; William Squire

(57) ABSTRACT

Disclosed is a reusable locking unit and a one time use electrically conductive molded thermoplastic shackle loaded with carbon black particles and having a linear resistance that is periodically monitored. The locking unit includes an integrated circuit for measuring shackle impedance through terminals capacitively coupled to the shackle. The terminals allow for adjustment of the length of the seal shackle in the locked secured state. The terminals and shackle form an RC network having a complex impedance that manifests the locked adjusted shackle length. Two AC signals at two different frequencies are used to measure impedance, which is compared with an initially determined or continually generated reference impedance to determine a tampered state of the shackle. Temperature compensation is also disclosed. A time stamp is stored for noting the tampering time of occurrence. A battery may be used to operate the circuit internal components and power from the remote transceiver may operate the circuit communication portion. Monitoring may be automatically periodic or activated only upon an external command. LEDs provide visual indication of the seal tamper status.

32 Claims, 13 Drawing Sheets

U.S. PATENT DOCUMENTS

| | | | | |
|---|---|---|---|---|
| 5,361,216 | A | 11/1994 | Warn et al. | |
| 5,450,657 | A | 9/1995 | Georgopoulos et al. | |
| 5,582,447 | A | 12/1996 | Leon et al. | |
| 5,656,996 | A | 8/1997 | Houser | |
| 5,969,613 | A * | 10/1999 | Yeager et al. | 340/572.9 |
| 6,046,616 | A | 4/2000 | Chan et al. | |
| 6,069,563 | A | 5/2000 | Kadner et al. | |
| 6,097,306 | A | 8/2000 | Leon et al. | |
| 6,265,973 | B1 | 7/2001 | Brammall et al. | |
| 6,297,735 | B1 | 10/2001 | Abel | |
| 6,389,853 | B1 | 5/2002 | Pate et al. | |
| 6,420,971 | B1 | 7/2002 | Leck et al. | |
| 6,542,114 | B1 | 4/2003 | Eagleson et al. | |
| 6,720,888 | B2 | 4/2004 | Eagleson et al. | |
| 6,727,817 | B2 | 4/2004 | Maloney | |
| 6,747,558 | B1 | 6/2004 | Thorne et al. | |
| 6,750,771 | B1 | 6/2004 | Brand | |
| 6,765,484 | B2 | 7/2004 | Eagleson et al. | |
| 2004/0113782 | A1 | 6/2004 | Auerbach et al. | |
| 2005/0231365 | A1 | 10/2005 | Tester | |

FOREIGN PATENT DOCUMENTS

| | | |
|---|---|---|
| GB | 2 254 719 | 10/1992 |
| GB | 2 368 174 | 4/2002 |
| WO | WO 97/34269 | 9/1997 |

OTHER PUBLICATIONS

Applicant's Response to Written Opinion Apr. 12, 2007.

* cited by examiner

ELECTRONIC TAMPER EVIDENT SEAL

This application claims the benefit of provisional application Ser. No. 60/507,174 filed Nov. 15, 2005 and incorporated by reference herein in its entirety.

This application relates to a cost effective electronic security seal for sealing cargo transportation units carrying a variety of goods and for detection of tampering with the transportation unit. The device also relates to the use of sensors for measuring additional properties such as temperature or humidity that may affect the quality of the goods transported.

It is well-known that transportation units for transportation of goods are susceptible to tampering. Theft of goods or replacements of original goods by fakes are problems facing the transportation industry. Transportation of goods occurs via a number of different modes and supervision of the goods can not be practically done during the entire transportation chain. A need is therefore seen for a security device for guaranteeing the integrity of a seal for a transportation unit. There is also seen a need for identifying the occurrence of a tampering event.

Cargo tamper evident seals are known. For example, of interest is copending commonly owned U.S. patent application Ser. No. 11/081,930 entitled Electronic Security Seal filed Mar. 16, 2005 in the name of Theodore R. Tester et al. published on Oct. 20, 2005 as US publication no. 2005-0231365. In the '1365 application, a battery operated cable security seal for cargo containers and the like includes a housing with a transparent cover for visual inspection of illuminated LEDs representing a normal or tampered state of a stranded metal locking cable. The cable is stranded steel wire that has an internal conductor whose electrical conductivity, e.g., resistance, changes in value to manifest a tampered condition when severed and also if reattached, e.g., by a solder or spliced joint and so on. The electrical continuity of the conductor, which is of fixed length and which is fixed to electrical terminals in the seal body, is monitored by a circuit in one embodiment for a severed state, i.e., tampering. The conductor resistance is monitored in a second embodiment correlated optionally to either or both ambient temperature and a battery output voltage to compensate for variations of resistance due to environmental influences.

A relatively costly steel stranded wire cable of the '1365 publication has an internal insulated wire of a fixed length. One end of the cable is fixed to the seal body and the other end is adjustably locked along the cable length to the seal body by a cable locking device, e.g., a collet. This arrangement is of the type disclosed in commonly owned U.S. Pat. No. 5,582,447, the collet wedging against the cable and housing in a tapered housing bore to lock the cable to the housing. An RFID communication system is also disclosed for communicating the state of the cable to an external device.

Of interest also is U.S. Pat. No. 6,046,616 assigned to TriTech Microelectronics Ltd., and U.S. Pat. Nos. 6,265,973; 6,097,306; 5,582,447, commonly owned with the present application.

In the cargo industry, containers are widely employed. The containers have doors which are locked shut with hasps and secured with mechanical locking seals. Robust steel bolt seals and stranded steel cable seals are widely used to lock the doors of cargo containers, truck doors or the doors of railroad cars, for example. Such seals may include a steel bolt, as shown, for example, in commonly owned U.S. Pat. No. 6,265,973, which discloses an electronic security seal by way of example. The bolts of seals, mechanical or electromechanical, are relatively costly, i.e., steel, and have a head and shank, which is attached to a relatively robust locking body having a shank locking mechanism. The mechanical seals with a locking mechanism using a steel bolt seal may also be of the type disclosed in commonly owned U.S. Pat. Nos. 4,802,700; 5,347,689; or 5,450,657.

Another mechanical seal, for use with a stranded metal wire cable, is disclosed in commonly owned U.S. Pat. No. 5,582,447 ('447). When a steel bolt shank or metal steel stranded cable is inserted into the locking body of the seal, the disclosed locking collet permanently locks the shank or cable to the body as the cable is pulled through the collet locking the cable about an article to be secured. Metal stranded cables and steel bolts are relatively costly for mass produced seals.

WO 97/34269 discloses a sealing device for remote electronic monitoring the secured status of the device. The device has a seal body engageable with a sealing device having an optical fiber cable or electrical wire coupled to an optical light transmission circuit or to an electrical circuit. The seal body contains a sensing arrangement which senses changes in characteristics of the circuit, i.e., a break in the continuity (optical or electrical) and communication arrangement which transmits a tamper condition to a remote location. The sealing device can include a single wire or an optical conductor forming a shackle with a protective sheath, which may be a flexible tape strip or which may be a relatively rigid member. The end terminals of the shackle are affixed in the seal body. The sensing arrangement produces a signal indicating a disconnection of the shackle and a change in the detectable circuit characteristics, indicating tampering.

GB 2 368 174 describes a security seal device with a detachable cable and a display indicating reopening. The cable is a part of a sealing member having enlarged heads at its ends. The enlarged ends fit into sockets in a housing and are locked into position by a movable sealing cover. A detector records if the cover is moved from a closed to an open position. The sealing member may complete a sensor circuit when attached to the housing for detection of tampering with the member.

U.S. Pat. No. 6,420,971 discloses an electronic seal with a housing and a closure member co-operable with the housing to form a seal. The closure member may be a coaxial cable which is fixed at one end to the housing by a fixture and the other releasable end is received in a recess and locked in position by a lock member. The coaxial cable has an outer steel sheath isolated from an inner conductive core by a thin isolating tube in such way that the core and the sheath form a capacitor, where the capacitance depends on the length of the cable. The fixed end of the inner core and the fixed end of the outer sheath are electrically connected to opposite terminals of an I/O device of a microprocessor contained in the housing. At regular intervals the I/O device outputs a voltage to charge up the cable capacitor to a predetermined charge and voltage. By measuring the decay of the voltage it can be determined whether the cable is intact or not.

U.S. Pat. No. 5,298,884 discloses a tamper detection circuit and method for use with a wearable transmitter tag comprising an electronic house arrest monitoring system. The tag is secured to a limb of a wearer by a lockable strap. The tag includes tamper detection circuitry for detecting attempts to remove the strap by cutting or breaking the strap even in the presence of an electrolyte. The strap has an embedded conductor in electrical contact with the tag. The detection circuit detects any changes in resistance of the strap.

Disclosed as prior art therein is U.S. Pat. No. 4,885,571, which discloses an electrostatic coupling device using a capacitive sensitive tamper detector with a central electrode and a strap electrode comprising a conductor also used for electronic house arrest monitoring by wrapping about a limb of a wearer. A capacitor detector detects a change in capacitance between the electrodes. The strap is disclosed as a flexible electrically conductive metal or wire laminated onto the strap. An alternating electrical signal is applied to the strap electrode creating an alternating electric field which emanates from the strap electrode. This field interacts with the central electrode to generate a current in the central electrode.

A critical part of known electronic seals is the connection of the electric circuit normally constituted by wires in the strap to the electronic circuit in the housing structure in order to monitor attempts at tampering or breaking of the strap. The end parts of the strap typically are specially designed and mounted in a receiving structure in the housing. This makes the design of the strap relatively costly and the mounting complicated. This arrangement also makes the strap less flexible for wide variety of applications needing different length straps, since the length of the strap in such seals is fixed and predetermined. As a result, the length of such straps, e.g., stool bolts, optical fibers, cables and wires etc., can not easily be adjusted to the needs of the specific goods to be sealed. Certain of the prior art discussed above discloses steel cables which are adjustably set to lock an article to the seal. However, these have fixed electrical lengths which is believed by the present inventors not as useful as a seal that can detect a change in length of the secured shackle. A need is seen by the present inventors for such a security seal.

One widely used strap known as a cable tie provides a reliable and easy to use strap seal, which can be tightened to the extent required by the application. To some extent it can provide tamper evidence. If it has been cut or the locking mechanism has been damaged, it can usually be detected by visual inspection. Such ties are only mechanical devices.

However, depending on the sophistication of the tamper event, it can be difficult to determine if the integrity of the strap has been compromised. A related problem is that it is difficult from a quality assurance perspective if a strap seal has been sufficiently tightened. A tamperer may be able to access the contents via a relatively loose strap and can thereafter tighten the strap. The receiver will then never understand if and when that tamper event occurred.

Further, as logistics processes, i.e., the chain of events involved in the transportation of goods, become more automated as a result of a wide implementation of automatic identification (AutoID) technologies, the need to replace visual tamper inspection with automated arrangements have increased. Traditional AutoID implementation involve usage of optically read barcodes, but there is now an increasing interest in replacing barcodes with radio frequency identification tags, more widely known as RFID tags. See the aforementioned copending application of Theodore R. Tester discussed above which uses such tags.

The present inventors recognize a need to solve the above problems with relatively more costly and complex steel bolt and steel cable seals and to provide a low-cost electronic tamper evident strap seal having the benefits of an adjustable strap that can be tightened about an article to be sealed with the addition of an electronic monitoring system such as disclosed in the aforementioned copending application of Tester et. al. These electronic security systems can be automatically and reliably monitored and are advantageously not prone to subjective judgment. Additionally, a need is seen for an electronic security system that fits into an AutoID infrastructure and allows the state of the monitored items to be scanned at the same time the identity information is retrieved without additional steps.

A need is also seen for a tamper evident strap seal, which is less complicated, of relatively low cost and easy to manufacture as compared to prior art seals discussed above and relatively easy to use on a large scale where a multitude of units need to be sealed.

An electronic security seal according to one embodiment of the present invention comprises a body; an elongated electrically conductive shackle; first and second electrically conductive terminals secured to the body and coupled to the shackle in a shackle locked state wherein the terminals form a complex impedance with the shackle, the impedance manifesting the shackle length between the terminals. A measuring circuit is included for measuring the impedance. A locking arrangement is also included for locking the shackle to the body.

In one embodiment, each terminal has a bore for receiving the shackle therethrough. In a further embodiment, the shackle is electrically conductive plastic.

In a further embodiment, at least one of the terminals is capacitively coupled to the shackle. In this embodiment, the impedance as seen from the measuring circuit is an RC network formed by the capacitance between the at least one terminal and the shackle and the electrical resistance of the shackle length between the one terminal and a second terminal. In a still further embodiment, at least one AC current is applied to the at least one terminal and to the second terminal through the shackle between the two terminals. In a further embodiment, the circuit applies two AC currents at different frequencies to the terminals and shackle length defined by the shackle portion between the terminals.

In a further embodiment, the shackle comprises an electrical insulator surrounding an electrically conductive thermoplastic core.

In a further embodiment, the circuit is arranged for measuring displacement of the shackle between at least one of the terminals and the shackle.

In a further embodiment, the circuit includes memory and an arrangement for measuring a first impedance value when the shackle is initially locked to the body at both ends and for storing the first value in the memory, the circuit for comparing further measured impedance values to the stored first value to generate a tamper signal when the further value differs from the first value by a predetermined amount.

In a further embodiment, a radio frequency (RF) transceiver receives and responds to an external interrogation signal to monitor the tamper state of the shackle.

In a further embodiment, the RF transceiver comprises a transmitter for transmitting data using back-scattering modulation.

In a further embodiment, the shackle first end is molded to a second body, the locking arrangement including a shackle locking member secured to the second body spaced from the shackle first end, and an arrangement for attaching the second body to the first body so that the shackle first end passes through the first body and is locked to the locking member.

In a further embodiment, the shackle second end passes through the first body, through the locking member and through the second body in spaced relation to the first end.

In a further embodiment, the first and second terminals each comprise a cylindrical member having a through bore for receiving the shackle therethrough.

In a further embodiment, a second body is included having first and second portions hinged to each other, the shackle having a first end attached to the first portion, the locking arrangement including a shackle locking member secured to the second body second portion and spaced from the first portion, the shackle locking member being aligned with the second terminal for receiving a shackle second end therethrough and spaced from the first end for locking the second end thereto, the first terminal for receiving the first end therethrough.

In a preferred embodiment, the first and second portions overlie one another, the first body having a recess for receiving the second body therein.

In a further embodiment, a temperature sensor senses the ambient temperature and a storage medium is included for recording the sensed temperature, also a transmission circuit subsequently transmits the measured impedance and the recorded sensed temperature.

An electronic tamper evident seal in a further embodiment comprises a locking unit and an electrically conductive shackle having opposing first and second ends. The locking unit includes first and second spaced electrically conductive terminals, the locking unit for locking the shackle first and second ends thereto, the length of the shackle between the first and second terminals manifesting a first impedance, the terminals for receiving and being electrically coupled to the shackle, at least one of the terminals forming a second impedance with the shackle, the first and second impedances forming a complex impedance.

In a further embodiment, the locking unit includes a circuit for measuring the value of the complex impedance, the locking unit being arranged to allow adjustment of the length of the shackle as the shackle is being locked to the locking unit to thereby adjust the value of the complex impedance and which impedance manifests the shackle length.

In a further embodiment, the shackle is conductive thermoplastic material and fixedly secured at the first end to the locking unit and movably secured at the second end to the locking unit for adjustment of the shackle length.

In a further embodiment, the seal is armed prior to shipment of the goods secured by the seal. The arming involves making an initial reference measurement of the mounted locked shackle, wherein a reference complex impedance of the strap and related coupling circuit is measured and stored. This reference impedance may be used in subsequent measurements to determine if the shackle has been damaged, loosened or tightened, or in the alternative, each successive impedance measurement is compared to a preceding impedance measurement to detect gradual or abrupt rapid changes in impedance, the latter manifesting a tamper event.

In a further embodiment, a measurement circuit feeds an AC signal into a complex impedance, comprising the resistance of the active part of the shackle between the terminals and the capacitive reactance formed by the shackle with one of the terminals, the circuit then measuring the complex impedance based on the resistive and capacitive impedance values. A multi-frequency measurement is made, where the impedance value is determined. The determined impedance value is compared with a reference value, and a change above a set threshold from the reference value triggers a tamper alarm.

In a further embodiment, wherein the shackle and at least one terminal present a complex impedance Z wherein $Z=R+jC$ where R is proportional to the adjusted active locked shackle length between two terminals one of which is the at least one terminal and where C is proportional to the coupling between the shackle and the at least one terminal.

In a further embodiment, a circuit is included for measuring the impedance Z, the circuit for applying two successive AC signals, each at a different frequency, to the at least one terminal through the shackle to an output terminal and measuring the impedance as a function of the values of the two AC signals at the output terminal.

In a still further embodiment, a control and memory cause the circuit to measure and store the value of a measured complex impedance in the memory and for periodically subsequently measuring and updating the stored complex impedance with a current measured impedance value and comparing the current measured periodic impedance to the last previously updated stored value, the control for causing the circuit to generate a tamper signal when the compared signals manifest a shackle tampered condition.

IN THE DRAWING

Figure 16:
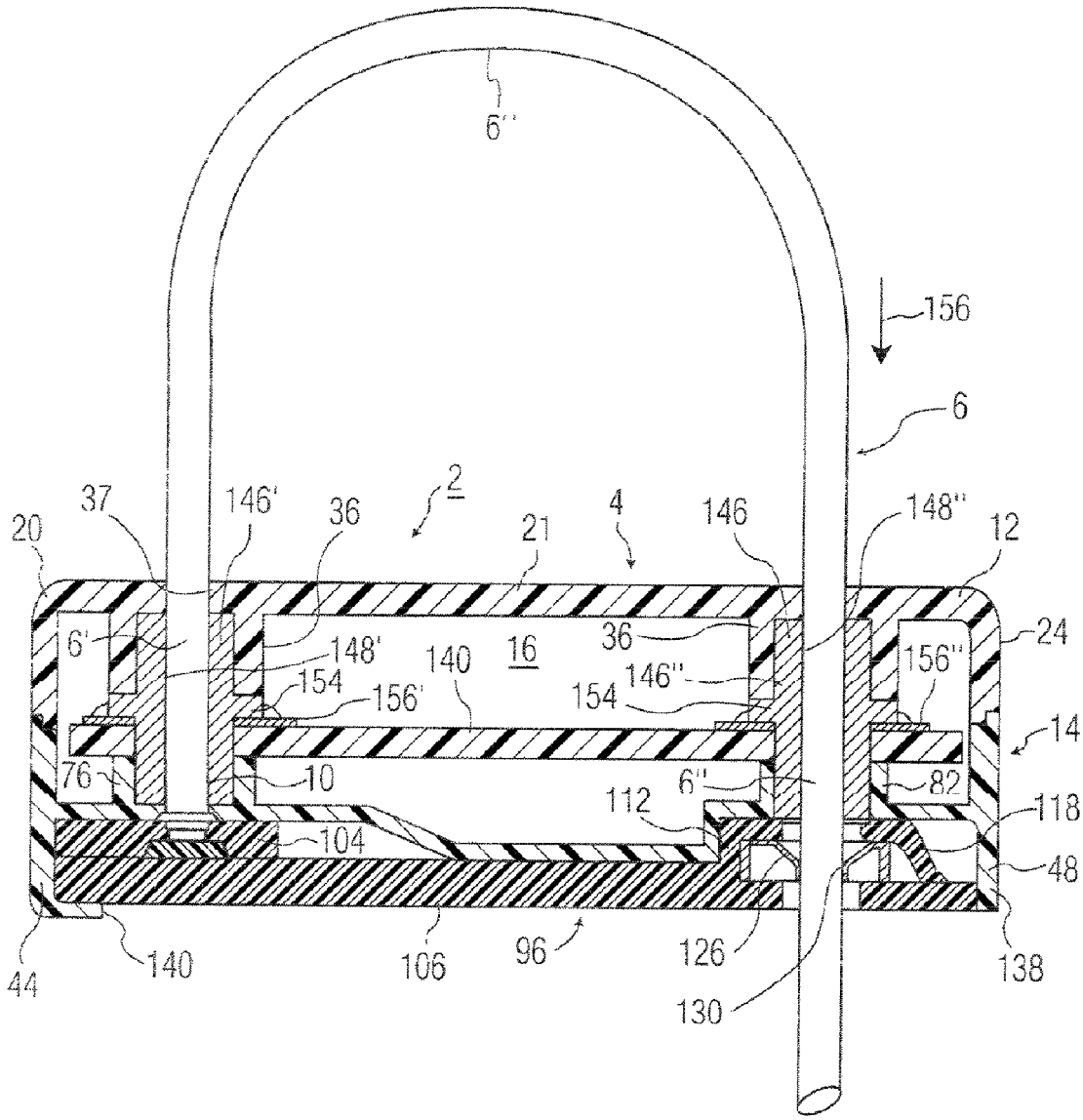
FIG. 16 is a side elevation cross section view of the seal of FIG. 4 taken along lines 16-16.
Figure 17:
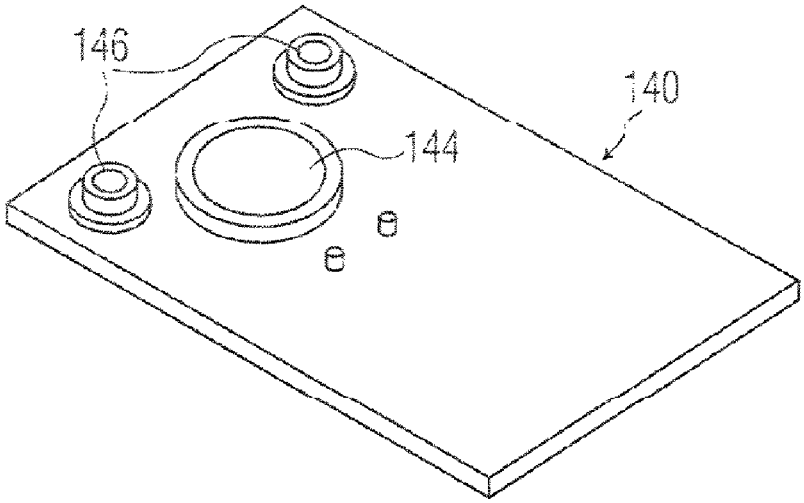
FIG. 17 is an isometric view of the printed circuit board used with the embodiment of FIG. 1 illustrating the two spaced terminals through which the shackle passes and the power source battery (associated electronics not shown in this figure)
Figure 17A:
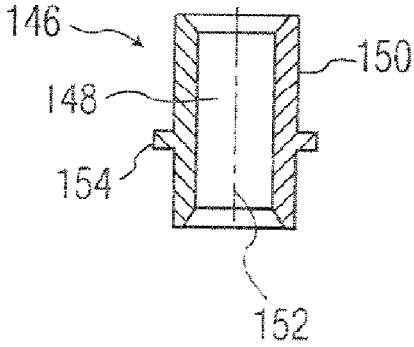
Figure 18:
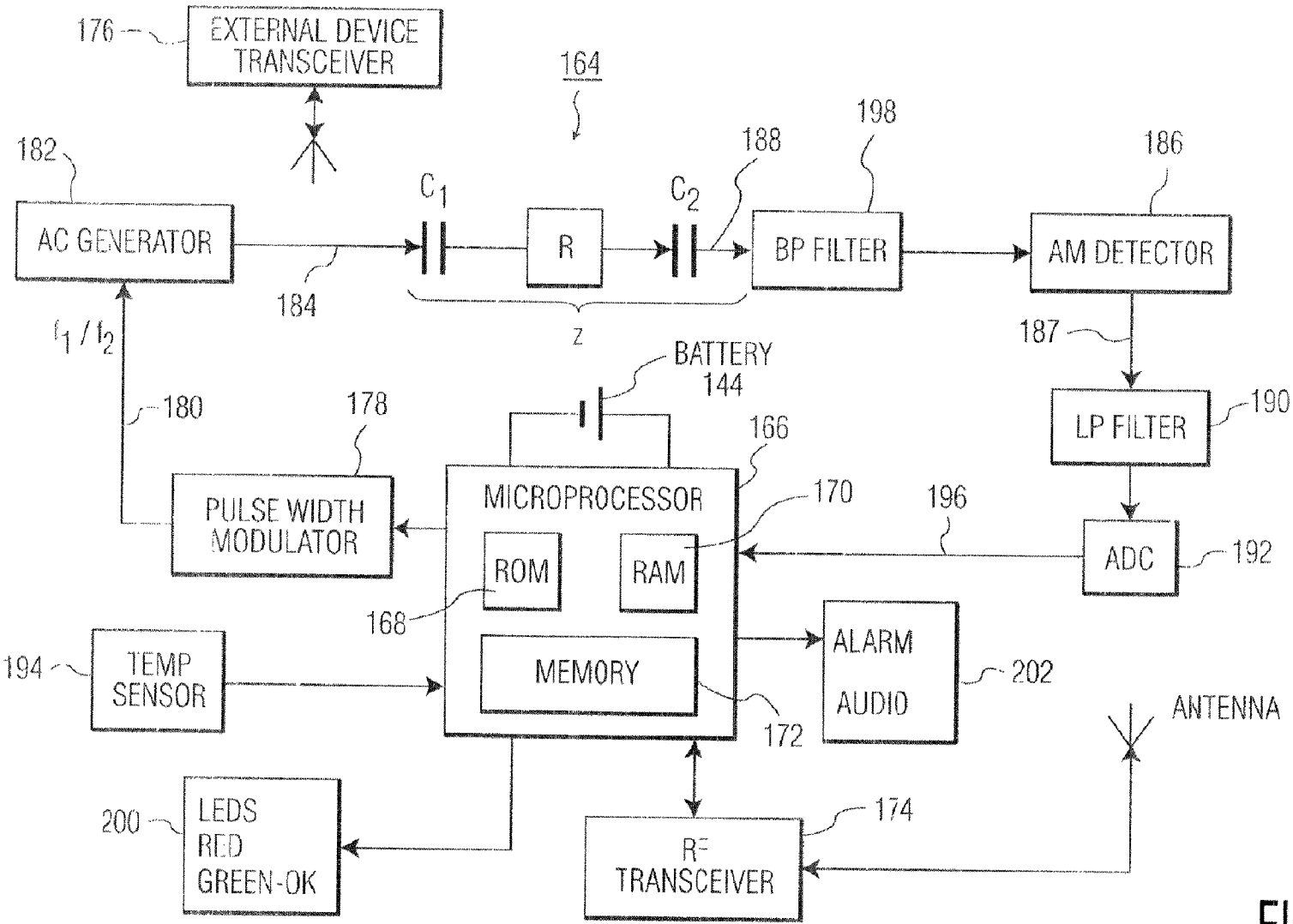

FIG. 17*a* is a side elevation sectional view of a representative terminal employed in the embodiment of FIGS. 16 and 17;

FIG. 18 is a circuit diagram of a representative circuit employed on the printed circuit board of FIG. 17

Figure 4:
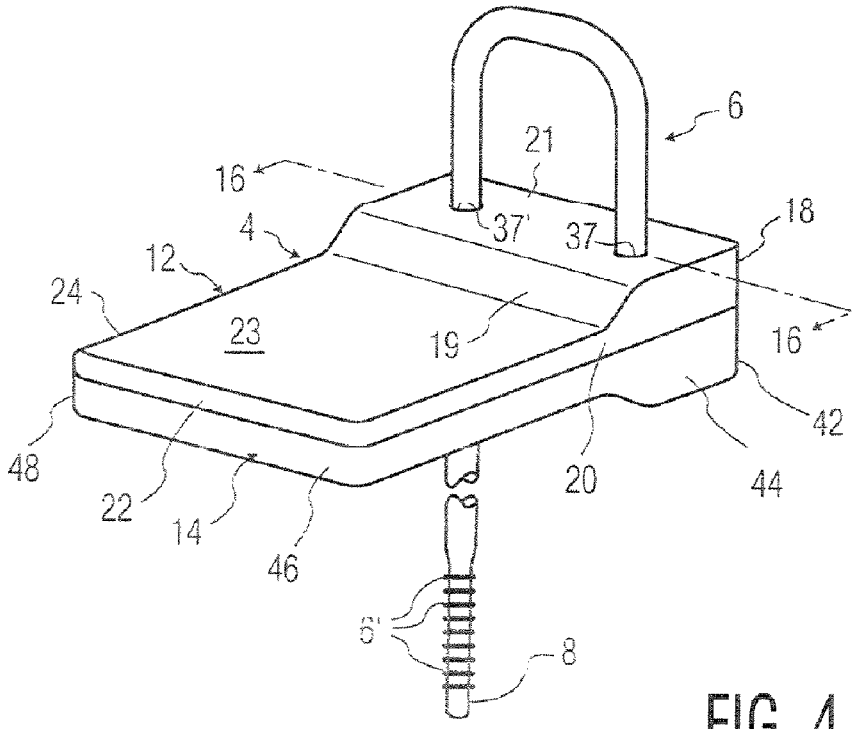
FIG. 4 is a top isometric view of the locked seal of FIG. 3.
Figure 19:
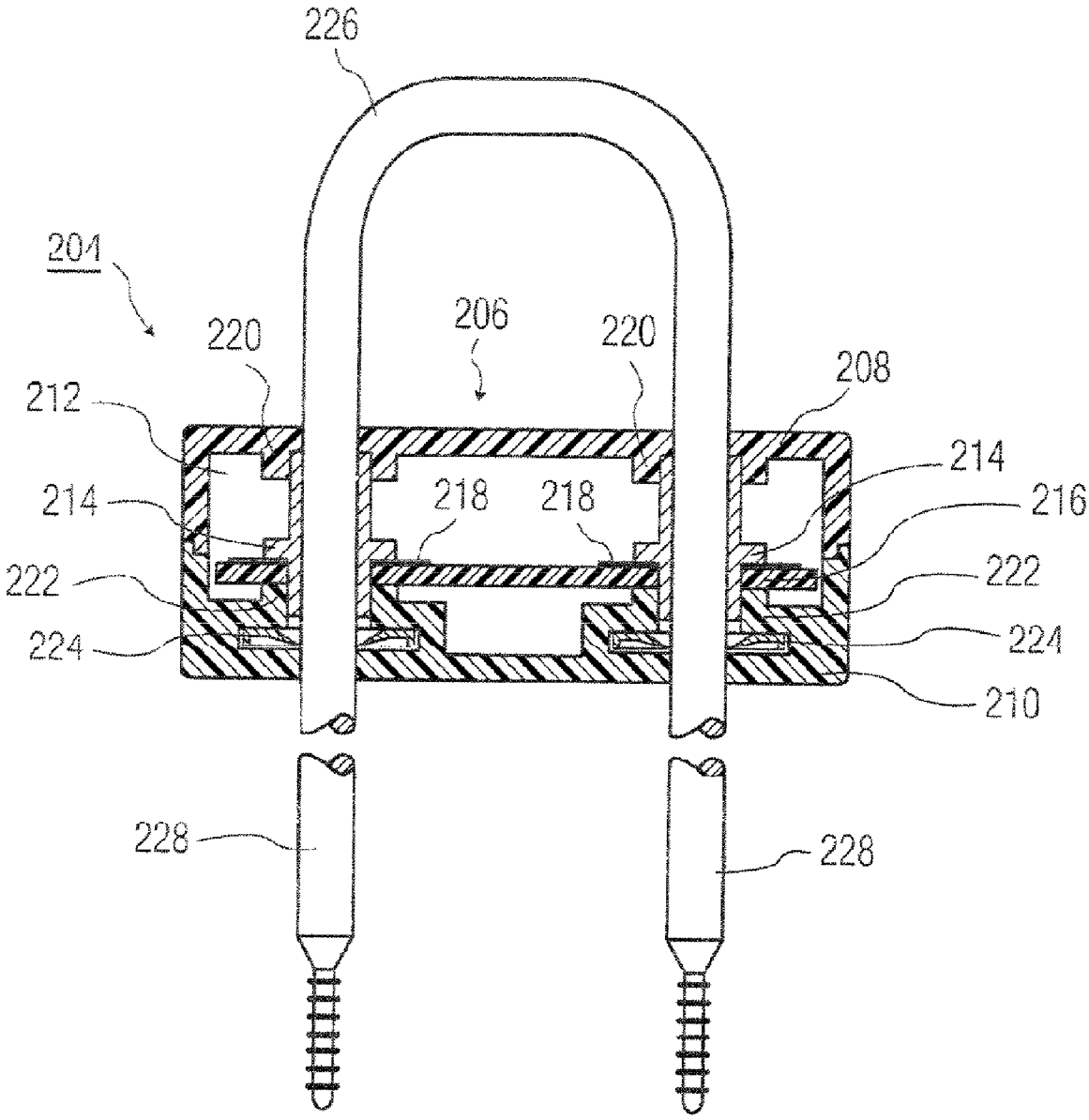
Figure 20:
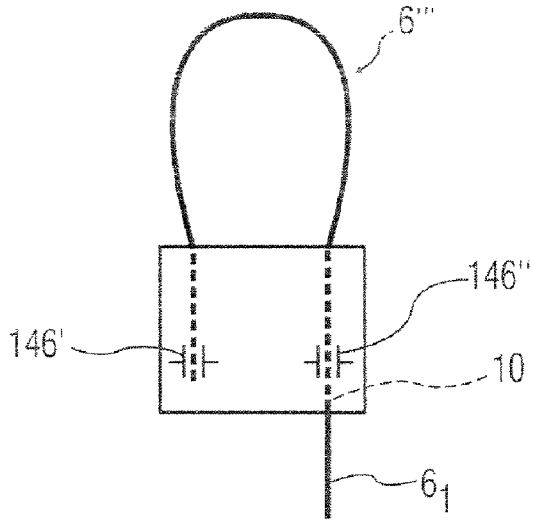
Figure 20A:
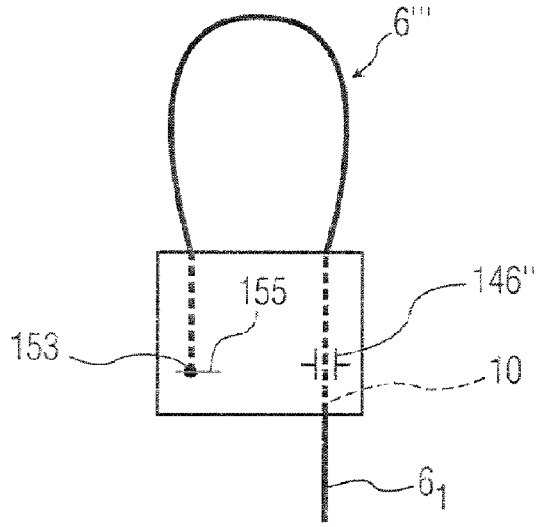
Figure 21:
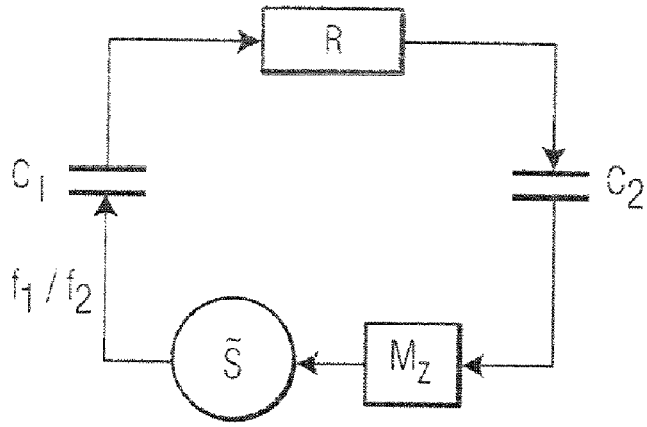
Figure 21A:
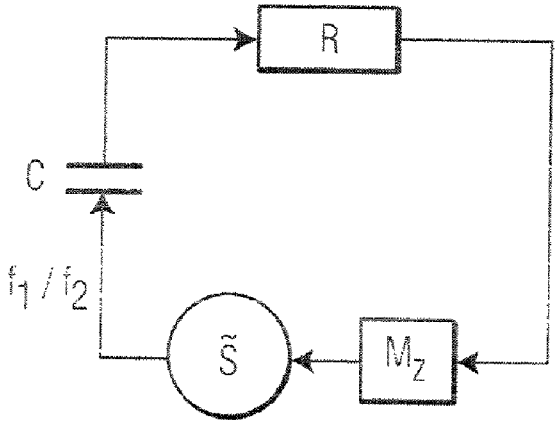

FIG. 19 is a side elevation cross section view of an alternative embodiment of a seal according to the present invention;

FIG. 20 is a schematic representation of the locked seal of FIG. 4 for purposes of illustration of certain principles;

FIG. 21 is a schematic representation of a portion of the circuit diagram of FIG. 18 useful for explanation of certain principles;

FIG. 20*a* is a schematic representation of the locked seal similar to that of FIG. 20 for purposes of illustration of certain principles; and FIG. 21*a* is a schematic representation of a circuit similar to that of FIG. 21 useful for explanation of certain principles.

Figure 1:
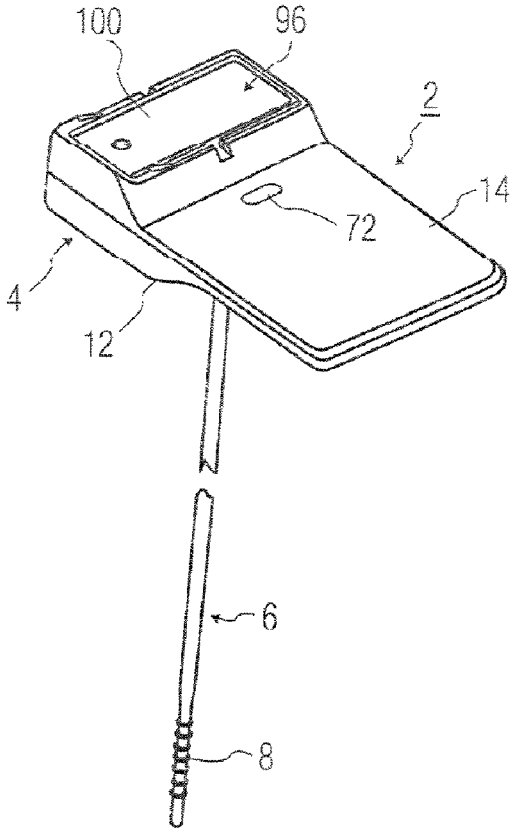
FIG. 1 is an isometric bottom view of a security seal in the unlocked stated according to an embodiment of the present invention.
Figure 2:
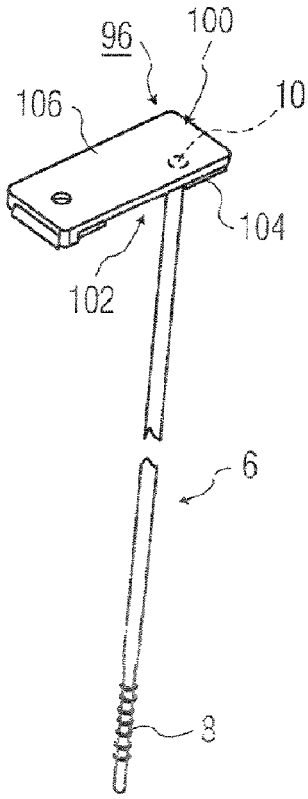
FIG. 2 is an isometric bottom view of the shackle and shackle attachment member to which one end of the shackle is fixed and employed in the embodiments of FIGS. 1 and 3.

In the embodiment of FIG. 1, seal 2 comprises a seal body 4 to which is attached a shackle 6. The seal body 4 contains a locking unit for locking the shackle thereto and a circuit for monitoring and transmitting the monitored integrity or tampered condition of the shackle. The shackle 6 has opposite first and second ends 8 and 10, respectively. The body 4 comprises upper and lower body portions 12 and 14, respectively, which snap fit together to form a composite housing body defining an internal cavity 16 (FIG. 16) containing the shackle locking unit and electronic monitoring circuitry to be described below.

The shackle 6 is securely locked to the seal 2 in this embodiment at one end, FIG. 1, and protrudes through the upper body portion 12, FIG. 4, through a bore 37 in the upper portion. This is the configuration of the seal 2 as it is made available to a user. The attachment of the shackle is convenient for the user as it will not be separated from or lost in transit between the factory and the user or distributor of the seals as might occur when the shackle and seal are separate from each other.

In use, FIG. 4, the shackle 6 is then inserted into a second bore 37' in the upper portion 12 by the user, passed through the entire seal body 4 where the shackle engages a shackle locking clip member, to be described below, until it emerges through the lower body portion 14 and locked to the seal 2 tightly wrapped about an article to be secured (not shown). The electronic seal 2 comprises two-parts, with a reusable locking unit and shackle monitoring circuit contained in the body 4 and a single-use shackle 6 which must be destroyed, i.e., severed, to open the seal. The shackle 6 is made of an electrically conductive material, which allows the integrity of the seal 4 to be monitored. The length of the tightened shackle is determined by the monitoring circuit which provides advantages over fixed electrical shackle lengths of the prior art. The measurement of the shackle length provides additional attributes that may be monitored and provide an indication of tampering not provided by seals with a fixed electrical shackle lengths.

Figure 5:
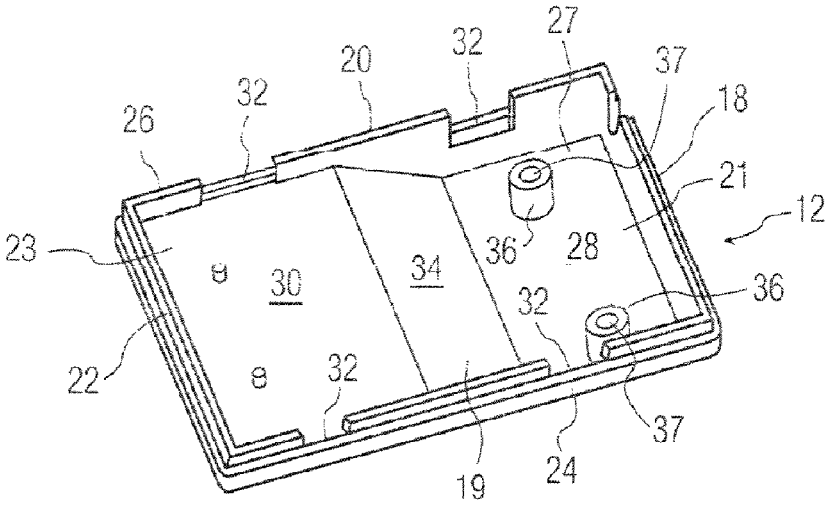
FIG. 5 is an isometric interior view of the top portion of the seal body of the seal of FIG. 1.

In FIG. 5, the upper body portion 12, which is molded one piece thermoplastic, includes side walls 18, 20, 22 and 24 which terminate at their upper edges 26 in a continuous stepped configuration. The portion 12 has three sections, 28, 30 and 34, sections 28 and 30 being spaced by an inclined fiat wall 19. Section 28 has a flat wall 21 and section 30 has a parallel flat wall 23 connected to wall 19. Walls 19, 21 and 23 form the top external walls of the body portion 12, FIG. 4. The wall 18 extends from wall 21 and wall 22 extends from wall 23. Walls 20 and 24 are mirror images, include detent female recesses 32 and extend from walls 21, 23 and 29. Two circular cylindrical stanchions 36 extend from wall 21 within the recess formed by the side walls 18, 20, 24 and wall 21. The stanchions 36 have a through bore 37 that extends through the wall 21. The stanchions 36 each receive a terminal 146, FIGS. 16 and 17*a*, via the stanchion bores 37. Walls 19, 21 and 23 form the top external walls of the upper body portion 12, FIG. 4. The bores 37 of the stanchions 36 and bores of the terminals 146 receive the shackle 6 therethrough as seen in FIGS. 4 and 16.

Figure 6:
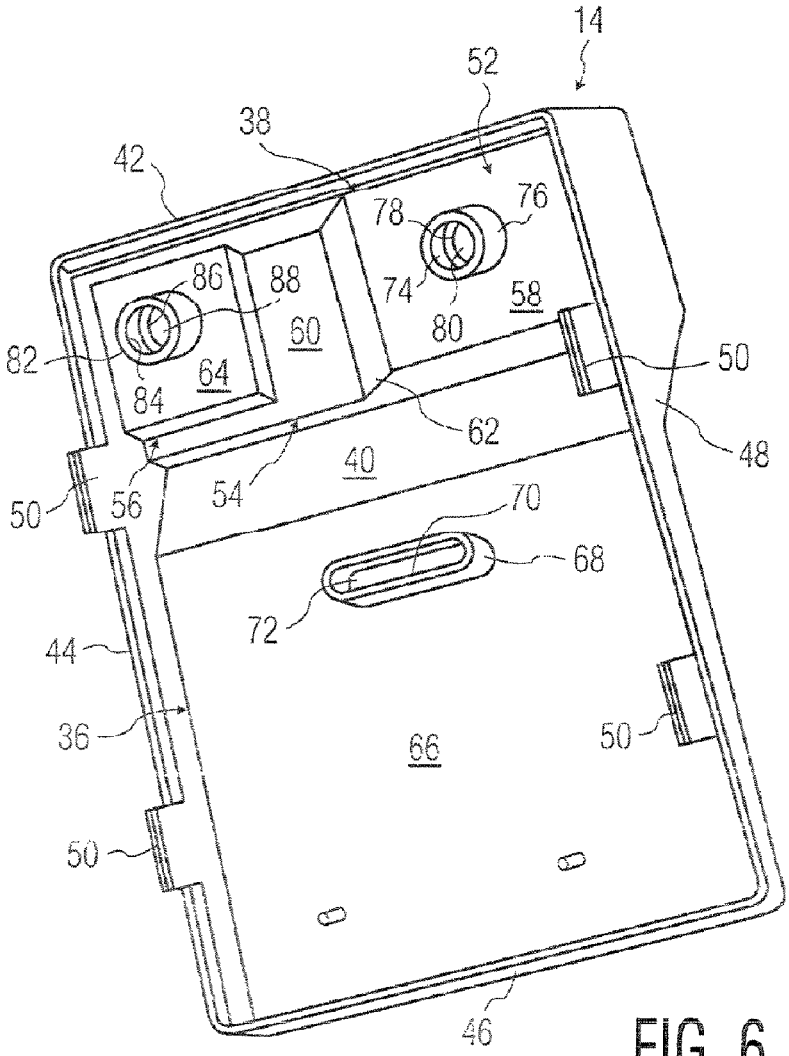
FIG. 6 is an isometric interior view of the bottom portion of the seal body of the seal of FIG. 1

In FIG. 6, the lower body portion 14 is molded one piece of thermoplastic material, which in this embodiment is the same material as the upper body portion 12. The lower body portion 14 has a planar bottom wall 66 in section 36 separated from a further complex bottom wall section 38 by an inclined planar bottom wall section 40. Upstanding side walls 42, 46, 48 and 50 extend from the bottom wall sections. Wall 42 extends from section 38, wall 46 extends from section 36 and mirror image walls 44 and 48 extend from sections 36, 38 and 40. The side walls 44 and 48 include male detents 50 which mate with detent recesses 32, FIG. 5, in the upper body portion 12 to attach the upper body portion 12 to the lower body portion 14 in snap fit relationship.

Section 38, FIG. 6, of the lower body portion 14 is divided into subsections 52, 54 and 56. Section 52 has a flat wall 58 that is spaced above flat wall 60 of section 54 and separated from wall 60 by inclined wall 62. Section 56 has a flat wall 64 parallel to wall 60 and spaced above wall 60, but not as high above wall 60 as is wall 58. Walls 58, 60 and 64 are parallel to flat wall 66 of section 36. The walls 66, 58, 60, 62 and 64 all form a bottom wall of a portion of the cavity 16, FIG. 16. The side walls 42, 44, 46 and 48 terminate at their upper edges 90 in a continuous step configuration that is complementary to and mates with the step configuration of the upper edges of the side walls of the upper portion 12, FIG. 5, to form the body 4, FIG. 1, defining cavity 16, FIG. 16.

An oval opening 70 is formed through the wall 66 and surrounded by an upstanding rim 68. A plug 72 of molded transparent thermoplastic is secured in the opening 70 forming a window through the wall 66.

A circular cylindrical stanchion 76 extends from wall 58 and having a bore 74 terminating at a circular radially inwardly extending flange 78. Flange 78 defines a circular cylindrical bore 80 through the wall 58 in communication with the external opposite side of wall 58. A second circular cylindrical stanchion 82 extends from wall 64 of section 56 and having a bore 84 terminating at a circular radially inwardly extending flange 86. Flange 86 defines a circular cylindrical bore 88 through the wall 64 in communication with the external opposite side of wall 64. The stanchions 76 and 82 each receive a terminal 146, FIGS. 16 and 17*a*, via the stanchion bores.

Figure 7:
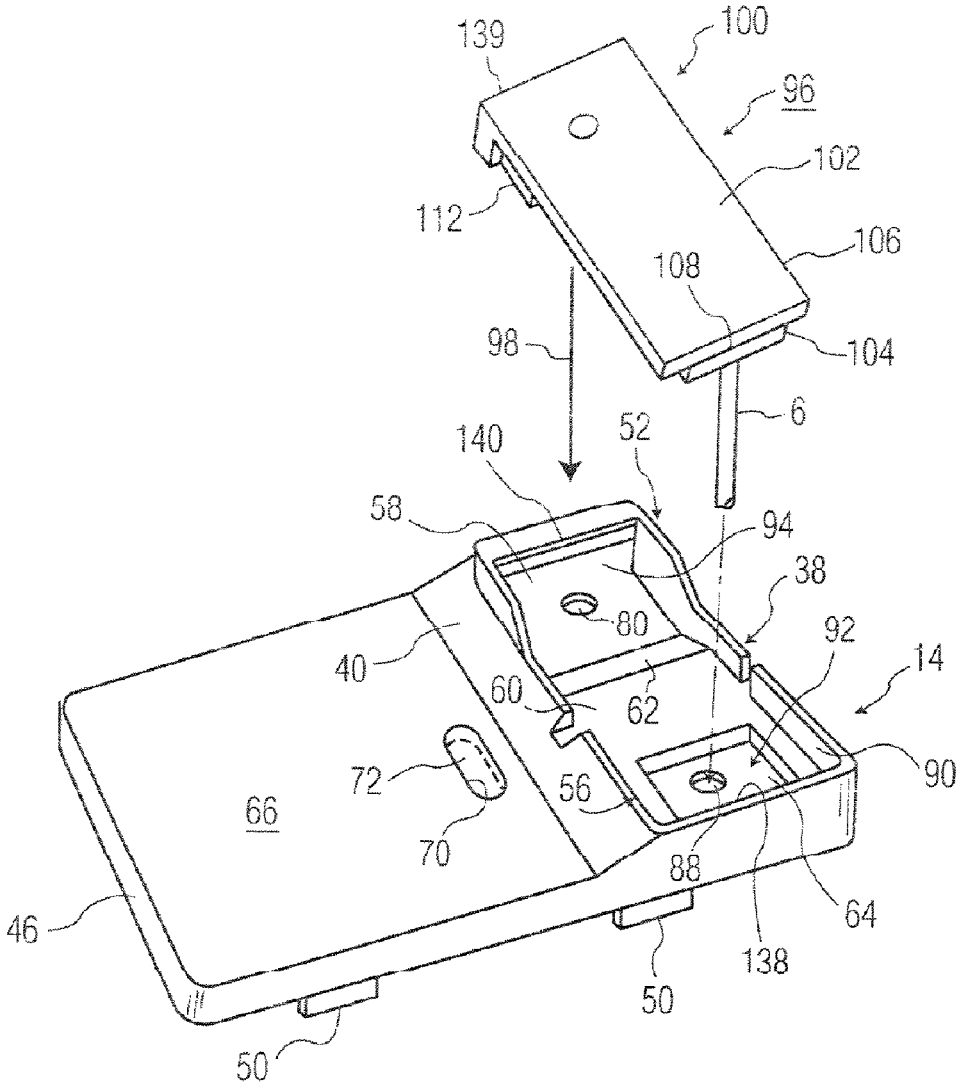
FIG. 7 is an isometric exploded external view of the bottom portion of the seal body of the seal of FIG. 1 in which the shackle and attached shackle attachment member are in position for being attached to a mating external recess in the seal body bottom portion and shown assembled to the seal body in FIGS. 1 and 3.

In FIG. 7, the lower body portion 14 exterior includes a section 38. This section forms a stepped recess 90 that has sub recesses 92 and 94 formed by respective recess bottom walls 64 and 58. Recess 92 is formed in the bottom wall 60 of subsection 56. Recess 94 is separated from bottom wall 60 by inclined wall 62. The section 38 is separated from wall 66 by inclined wall 66. Shackle subassembly 96, which comprises shackle 6 and a locking body assembly 100 is assembled into the recesses of section 38 in the direction of arrow 98 in a snap fit relation in one embodiment. The shackle is passed through the bore 88 in recess 92 to form a further subassembly comprising the shackle subassembly 96 and shackle 6.

Figure 9:
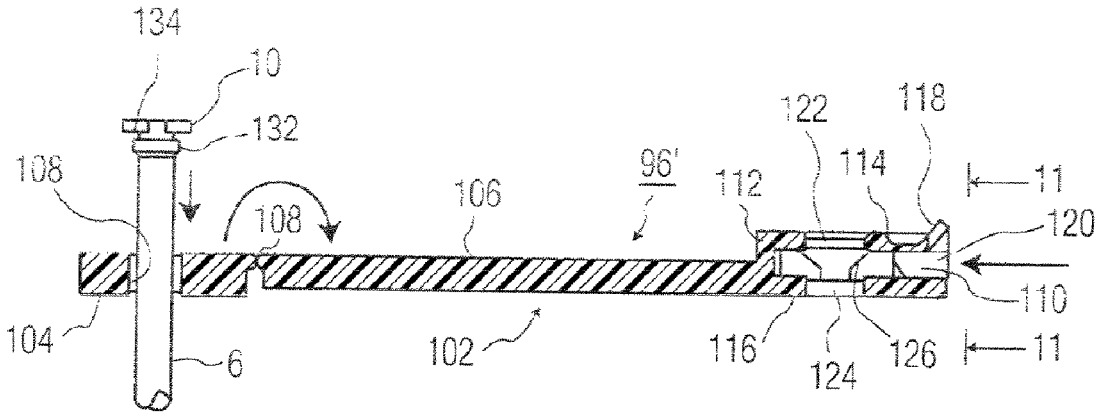
FIG. 9 is a side elevation sectional view of the shackle attachment member of FIGS. 2 and 7 and shackle end prior to the fixation of the shackle end thereto.

In FIG. 9, the locking body subassembly 96' prior to final assembly to form subassembly 96 is shown. The subassembly 96' comprises a molded thermoplastic body 102 in this embodiment which comprises the same material as the upper and lower body portions 12 and 14 forming the housing body 4 (FIG. 1). The body 102 is initially formed of two coplanar planar rectangular portions 104 and 106 joined by a hinge 108. Portion 104 is smaller than portion 106 and has a stepped through bore 108. A rectangular recess 110 is formed in the other opposite end of the body 102. The recess 110 is formed in a raised rectangular projection 112 with flat walls and extending above the plane of the body 102.

Figure 11:
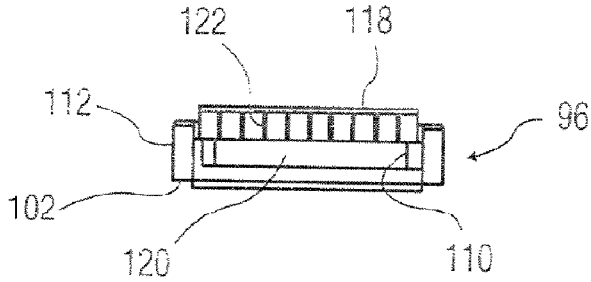
FIG. 11 is an end elevation view of the attachment member of FIG. 9 similar to the view taken along lines 11-11 of FIG. 9.
Figure 14:
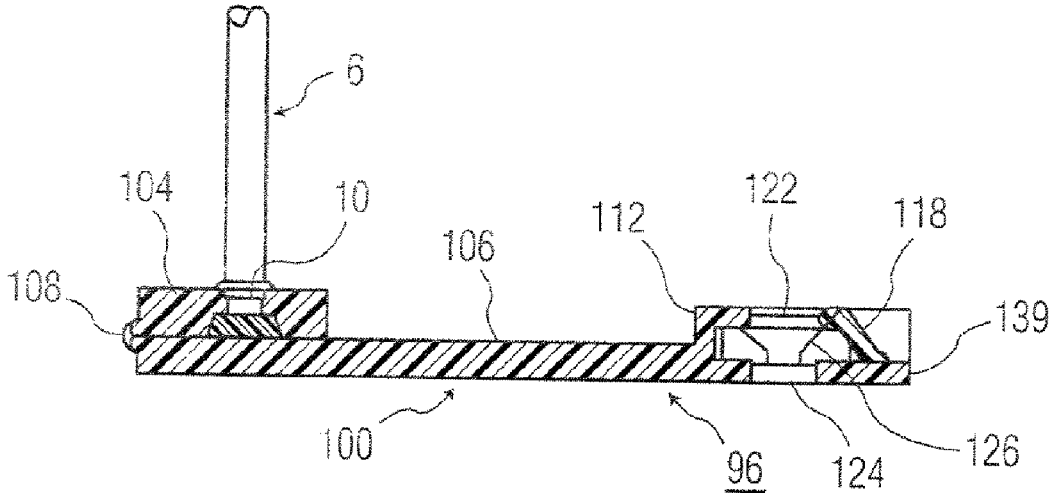
FIG. 14 is a view similar to that of FIG. 9, but with the shackle attached to the shackle attachment member with the clip of FIG. 10 attached to the attachment member and in the configuration of FIG. 2 ready to be assembled to the seal body bottom portion.

The projection 112 has spaced parallel upper and lower respective planar walls 114 and 116 forming the recess 110 with upstanding side walls, wall 116 being coplanar with portions 104 and 106. A hinged door 118 extends from an end edge of wall 112, which edge is also adjacent to and spaced above the end edge of wall 116 forming an egress opening 120 which provides access to the recess 110. In FIG. 11, the door 118 has parallel grooves 122 forming the door 118 with sections which assist in ultrasonically welding the door shut as shown in FIG. 14. Aligned bores 122 and 124 are in the upper wall 114 and lower wall 116, FIG. 9.

Figure 10:
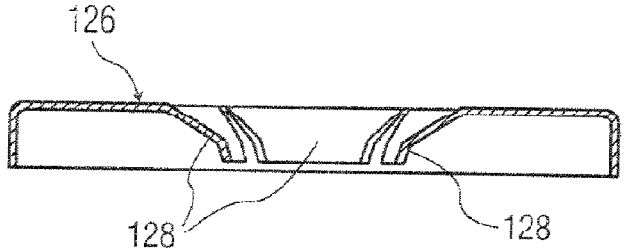
FIG. 10 is a side elevation cross section view of the locking clip used in the embodiment of FIG. 9.
Figure 15:
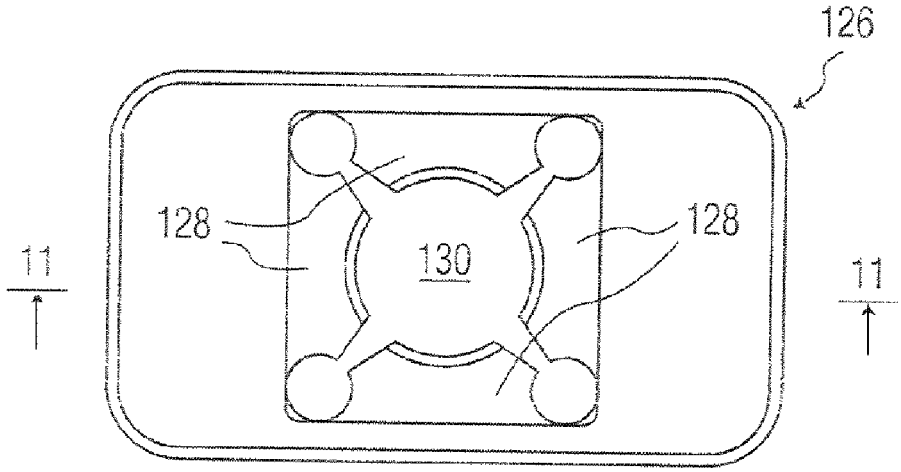
FIG. 15 is a top plan view of the locking clip of FIG. 10.

In FIGS. 10 and 15, a shackle locking clip member 126 is inserted into the recess 110. The clip member 126 is formed from stamped steel, is conventional, and has shackle gripping tangs 128 which define a circular opening 130 for receiving and locking the shackle 6 thereto in one way action. After the clip member 126 is in the recess 110, the door 118 is hinged closed to the position of FIG. 14 and ultrasonically welded shut. The opening 130 of the clip is aligned with the shackle receiving bores 122 and 124 in the body 102, FIG. 9, of the locking subassembly 96, FIG. 14.

Figure 12:
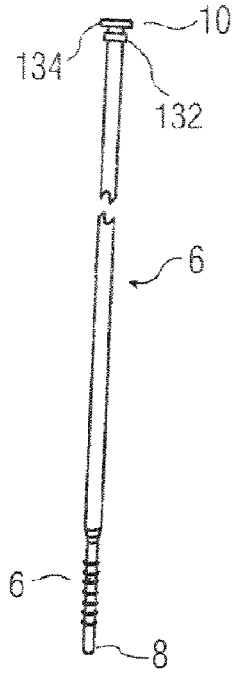
FIG. 12 is a side elevation fragmented view of the shackle of the embodiments of FIGS. 1-3.
Figure 13:
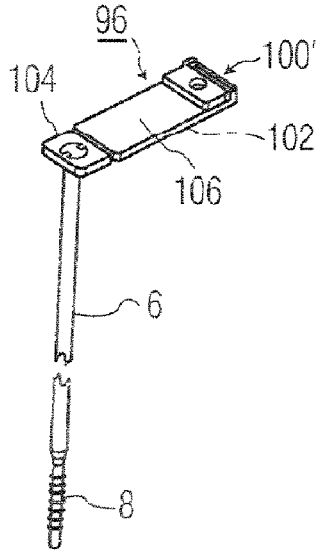
FIG. 13 is a fragmented isometric view of the attachment member and attached shackle of the embodiment of FIG. 2 in an intermediate stage of assembly of the attachment member.

In FIGS. 9 and 12, the shackle 6 second end 10 is formed with a collar 132 near the end of the shackle and a cylindrical disc flange 134 at the end. The end 10 is inserted into the bore 108 of the portion 104 of the body 102. The end 10 is then molded to the portion 104 of the body 102 or in the alternative attached in any other way such as ultrasonically welding and so on. This secures the shackle 6 to the body 102 as one piece therewith forming the subassembly 96, FIG. 13. In FIG. 9, the portion 104 is then folded over in the direction of arrow 136 to the configuration of FIG. 14 forming the final assembly of subassembly 96 of this embodiment. This configuration of the subassembly 96 is then attached to the section 38 recesses 90, 92 and 94 of the lower body portion 14 of the seal body 4 as shown in FIG. 7. Of course, the shackle 6 may be attached in other ways in other embodiments such as by a further clip member 126 at this shackle end. This shackle end also in this further embodiment may be movably attached to the further clip or fixedly attached to the seal by this further clip. In this latter embodiment the further clip may also be used as an electrical terminal to connect this end of the shackle to the impedance measuring circuit described below in more detail.

Figure 3:
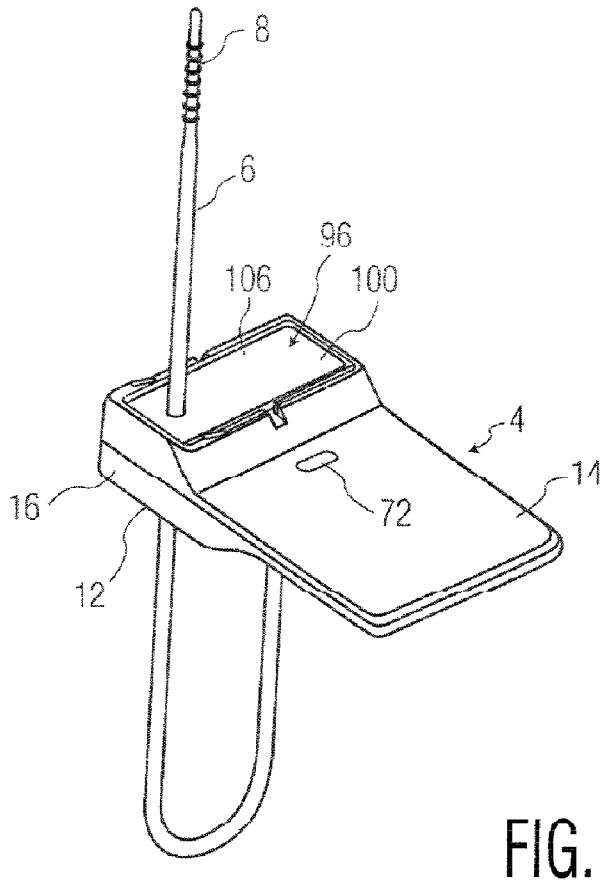
FIG. 3 is a bottom view similar to the view of FIG. 1 showing the shackle in the locked state for securing an article thereto wherein the free end of the shackle is locked to the seal forming a closed locked shackle loop.

The projection 112 of body 102 mates in recess 94, FIG. 7, of the lower body portion 14 and the body portion 104 of the body 102 mates in recess 92. The body 102 mates in the larger recess 90 formed by section 38. The hinge 108 may protrude somewhat from the body 102 and form a snap fit with a lip 138 of the lower body portion 14, FIG. 7. The other opposite end 139 of the body 102 also may form a somewhat snap fit with lip 140 at the other end of the body portion 14. The snap fit of the subassembly 96 to the seal body 4 is optional. The shackle subassembly 96 is locked to the seal body 4 when the shackle free end 108 (FIG. 12) of the shackle 6 is locked to the clip member 126 in the subassembly 96, FIG. 16. The shackle 6 at this time is drawn tightly about an article to be locked in the locked state of FIG. 3 as it slides through the terminal 146" and clip member 126. Thus the subassembly 96 can not be removed from the lower body portion 14.

In FIG. 17, a printed circuit board (PCB) assembly 140 comprises a conventional PCB substrate 142 with circuit components, schematically represented in FIG. 18. These components include a microprocessor 166, analog-to-digital converter (ADC) 192, low pass filter (LP filter) 190 and bandpass filter (BP filter) 198, alternating current (AC) generator 182, antenna, radio frequency telemetry (RF) transceiver 174 and so on as described in more detail below. The assembly 140 also has printed wiring (not shown) on a surface of the PCB, the components being galvanically connected to the wiring in conventional fashion. A conventional battery 144 is coupled electrically conductive to the circuit. A pair of metal electrically conductive cylindrical terminals 146, FIG. 17*a*, are attached to the assembly 140 in spaced relation to each other.

In FIG. 17*a*, a representative terminal 146 comprises an electrically conductive material, i.e., metal and particularly, brass (or nickel plated steel) in this embodiment, that has a cylindrical through bore 148 in a circular cylindrical member 150. A circular cylindrical flange 154 extends radially outwardly from the member 150 somewhat medially of the member longitudinal axis 152. The seal body 4 cavity 16, FIG. 16, may be filled with a conventional potting compound to make it impervious to water and moisture and further adds mechanical tamper protection.

An additional arrangement (not shown) may be added to detect if there has been a tamper event with respect to the seal body 4. That is, attempts made to separate, or the actual separation of, the upper body portion 12 from the lower body portion 14 may also be monitored if desired by an additional electronic monitoring device (not shown).

In FIG. 16, the assembly of the shackle 6 to the seal 2 in the locked state is shown. The metal electrically conductive terminals 146' and 146" (the parts with primed reference numerals are identical to the parts with unprimed reference numerals) are each electrically connected by a galvanic contact to a respective circuit conductor 156', 156" of the printed wiring circuit (not shown) on the PCB of the circuit board assembly 140 such as by soldering and the like. The shackle portion 6' passes through the bore 148' of the terminal 146'. Portion 6' of the shackle, narrowed at its end 8 to permit passage through the various bores, is permanently attached to the subassembly 96 and thus is always present in the bore of terminal 146'.

When the shackle 6 is to be locked to the seal 2 to secure an article thereto, the narrowed end 8 of the shackle 6 (which has relatively thin annular ribs 6', FIG. 4, to enhance the finger gripping action on the shackle, FIG. 12) is pulled through the terminal 146", FIG. 16, and fully tightened about the article (not shown) to be secured by shackle portion 6". As the shackle is pulled through the terminal 146", it also passes through the opening 130 of the clip member 126. The opening 130 is in interference fit with the shackle so as to dig into the shackle and prevent the shackle from being withdrawn in an unlock direction opposite to the insertion direction of arrow 156. The clip member 126 forms a one way locking clutch in a known manner against the inserted shackle 6 to permanently lock the shackle to the seal body 4.

The shackle 6, in one embodiment, is injection molded, and comprises an electrically conductive plastic, such as polypropylene or polyamide loaded with electrically conductive carbon particles, and formed into a unitary shackle. Low cost commercially available carbon black formulations, traditionally used for anti-static shielding, give good results. One particular material for the shackle 6 in this embodiment is known as Cabelec XS4865, a registered trademark of and available from Cabot Corporation. This material is a carbon black loaded polypropylene compound for injection molding. This material has a surface resistance of $10^2$ ohm/sq and a volume resistance of 11 ohm.cm which resistance is linear along the shackle length.

Figure 8:
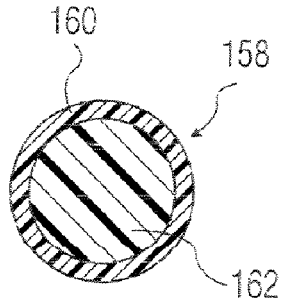
FIG. 8 is a cross sectional view of an alternative embodiment of the shackle for use with the seal embodiment of FIG. 1.

Another option for the shackle material is plastics with conductive polymers, such as polyaniline. In FIG. 8, shackle 158, in an alternative embodiment, has an electrically insulating outer layer 160 and an inner core 162 of electrically conductive plastic as described above for the shackle 6. The configuration of the shackle 158 is to minimize influence of external conductors, which potentially could short circuit the conductive shackle and also to provide a pure capacitance to the shackle core from a terminal 146' or 146", FIG. 16.

When the shackle 6 is tightened about an article (not shown), an electrically conductive loop 6''' (FIG. 16) is formed by the shackle with and including the terminals 146' and 146". The loop portion 6", which extends from terminal 146' to terminal 146", forms an active resistance to be measured as explained below, The shackle portion 6" length to the terminals 146' and 146", which is adjustable, in this embodiment, is used to monitor the integrity of the seal, i.e., the integrity of the shackle.

The shackle 6 in this embodiment is about 0.150 inches (3.8 mm) in diameter +/−0.001 inches (0.0254 mm) and may be about sixteen inches (40 cm) in length. The two terminals 146' and 146" are identical in this embodiment and have a bore 148 diameter (FIG. 17*a*) of about 0.154 inches (about 3.9 mm) +/−0.001 inches (about 0.0254 mm). This relationship provides a clearance of about 0.004 inches (0.1 mm). This clearance provides a capacitance between each terminal 146' and 146" and the shackle portions 6' and 6". In the alternative, the shackle 158 of FIG. 8 when substituted for shackle 6 exhibits a different capacitance due to the presence of the insulation layer 160 between the core 162 and terminals 146' and 146".

In FIG. 20, a schematic diagrammatic representation of the configuration of FIG. 16 is shown for simplicity of illustration. The active shackle portion 6''' is between the terminals 146' and 146" and the passive inactive portion of the shackle $\mathbf{6}_1$ extends beyond the terminal 146". The length of the tightened active portion 6''' is monitored. This length tends to differ among different uses of the seal 2 when a given seal is locked to an article in a one time use.

FIG. 21 shows the equivalent electric circuit of the schematic representation of the device of FIG. 20, where the resistance of the shackle portion 6''' to the terminals 146' and 146" has value R. The connections of the shackle portions 6' and 6" (FIG. 16) to the respective terminals 146' and 146" each form a capacitive element in this embodiment. The shackle 6 is pulled through the terminal 146" during the locking mode which allows the shackle 6 length to be adjusted on an individual basis for each application. This arrangement of the shackle 6 with the terminals 146' and 146" results in a complex electrical impedance comprising an RC network of the combined shackle and terminals 146' and 146". In FIG. 21, the active shackle portion 6''' between the terminals thus forms a resistor of value R in series with two capacitors C.

In the alternative, in FIGS. 20*a* and 21*a*, one terminal 153, which may be a clip such as clip member 126 shown in FIGS. 10 and 15, for example, may form a direct galvanic connection by soldering or otherwise connecting it to a printed circuit conductor 155 wherein the shackle (resistance R) is directly electrically conductively connected to the measuring circuit $M_z$ or signal source S with no capacitance present between the source S or circuit $M_z$ and the resistance R. In this embodiment, only a single capacitance C, FIG. 21*a*, is in series with the resistance R of the shackle. In FIG. 21, one of the capacitances $C_1$ or $C_2$ thus is replaced by a direct galvanic connection 153 between R and the circuit of FIGS. 20*a* and 21*a* comprising an AC signal source S and the impedance measuring circuit $M_z$.

A variety of known methods can be used to measure the impedance Z and further quantify the resistance R and the capacitance C of the circuit via the microprocessor 166, FIG. 18. One simple approach is to couple Z to a divider network (not shown), which is fed by an AC signal. By monitoring the voltage drop over Z at different frequencies via the microprocessor 166, FIG. 18, R and C can be quantified.

The overall impedance Z can be expressed as $$Z(f)=\sqrt{(R^2+(1/(2\pi fC))^2)}$$

where R is the resistance of the shackle portion 6''' and C is the capacitance of the circuit between the shackle and at least one of the circuit conductor(s) (via at least one of the terminals 146' or 146").

Assuming that C is constant with an impedance inversely proportional to f and that R is constant and independent of f, making two measurements at frequencies $f_1$ and $f_2$ respectively allows the solution of R and C. A varying length of the shackle affects in theory the value of R only (the capacitance between the strap and terminals doesn't change because each of the diameters of the bores of the terminals 146' and 146" is a constant one value and the diameter of the shackle 6 along its length is a constant one value, FIG. 16). By measuring Z at two frequencies, a changing C (due to change in coupling) or a due to a variable length shackle can be distinguished. To maximize the sensitivity of the circuit, the frequencies $f_1$ and $f_2$ and the shackle resistance R are selected such that $R \approx 1/(2\pi fC)$ In FIG. 18, the circuit 164 disposed on the circuit board assembly 140, FIG. 16, comprises a power source, i.e., battery 144, a microprocessor 166 including ROM 168, RAM 170 and memory 172, and a clock (not shown). The circuit also includes a radio frequency RF transceiver 174, which is a radio-telemetry interface coupled to the microprocessor to allow the circuit 164 to be interrogated by and transmit to an external transceiver device 176. Device 176 includes a transceiver similar to transceiver 174 for example. The transceivers may be a short-range radio, typically operated in the Industrial, Scientific and Medical (ISM) band or a backscattering transponder to be used in a standard Radio Frequency Identification (RFID) infrastructure.

The circuit 164 further includes a pulse width modulator (PWM) 178 and a low pass filter represented by AC generator 182, synthesizes AC signals at at least two different frequencies. The two successive PWM different frequency signals from the modulator 178 are generated as digital signals on modulator output line 180 and applied as an input to the AC generator 182 (a LP filter) which converts each of the digital signals to a sine wave, where high order harmonics have been suppressed from the generated digital signals. The generator 182 outputs the desired AC sine wave signals on output line 184 which is then applied to terminal 146' (FIG. 16). State-of-the-art microcontrollers typically feature a pulse width modulation (PWM) circuit, which can be used to generate the desired digital signals each at a given predetermined frequency.

Line 184 is connected to AM (amplitude modulation) detector 186 via line 188 through the series connection of capacitance $C_1$, resistance R, capacitance $C_2$ and band pass filter 198. Capacitance $C_1$ represents the capacitance from the shackle portion 6', FIG. 16, to the terminal 146', resistance R it will be recalled represents the resistance of the active portion 6''' of the shackle 6 between the terminals 140' and 140", and capacitance $C_2$ represents the capacitance between the shackle portion 6" and the terminal 146". The output of the amplitude modulation AM detector 186 at line 187 is applied as an input to the microprocessor 166 through the series connection of low pass LP filter 190 and analog digital converter ADC 192.

The detector 186 is in its simplest form is an AM detector comprising a low-cost switch diode and a tank capacitor. Depending on the level of the AC signal, an additional bias can be added to increase the detector sensitivity. Alternatively, a back-biased switching diode can be used to increase the DC level of the detected signal, thereby increasing sensitivity. Yet another way of increasing the sensitivity without introducing a DC bias to the detector 186 is to use a Schottky-type dual-diode detector configuration. By using a low Cd Schottky device, the detector 186 sensitivity can be further enhanced.

Optional bandpass BP filter 198 is before the detector 186 to filter out low- and high-frequency interference such as 50/60 Hz electrical fields from incandescent lamps, which can cause high-voltage injection into the detector 186 and cause invalid readings. Further, high-frequency RF-signals with high field strengths, such as terrestrial radio systems and cellular telephones could be detected by the AM detector 186 and cause invalid readings, if not properly filtered out.

When the shackle 6 is inserted through the terminal 146" and clip member 126, FIG. 16, and tightened as desired, the impedance measurement can begin by issuing a special "arm" command to the microprocessor 166 via the external device 176, FIG. 18. When the arm command is received by the transceiver 174 and microprocessor 166, the mean value of R of the shackle portion 6" and C is measured and stored as a reference value in one embodiment. Thereafter, measurements are performed at a fixed interval, typically every second. An averaging algorithm is used to update the reference value with subsequent readings in such a way that slow transitions due to temperature fluctuations, e.g., are filtered out, where fast (such as shackle removal or damage) can be detected.

Alternatively, the circuit 164, FIG. 18, in another embodiment is programmed to periodically scan the circuit to determine if a strap has been inserted. After a certain "dwell (or setting) time," an implicit arm operation would then be conducted.

Optionally, the circuit 164 may include a temperature sensor 194 to allow monitoring and recording of the ambient temperature at the seal 2 or for other monitoring as noted below.

The low pass LP filter 190 suppresses the AC component of the output signal on line 187. This filter 190 output is fed to the ADC 192 to convert the envelope of the AC signal into a digital discrete value for further processing by the microprocessor 166. The ROM 168 includes a conversion algorithm (not shown) for signal conditioning of the discrete input values to perform an analysis of these values and to perform various other tasks as explained herein which may be programmed by one of ordinary skill in this art.

The discrete signal values read by the microprocessor 166 at line 196 are analyzed such the output values manifesting the signals at two different frequencies $f_1$ or $f_2$ are used to calculate the impedance Z. This measured value is compared with the initial measured value that was stored in memory 172 at the time the system was initially armed by the external transceiver 176. That is, the initial measured Z value at the time the system is armed is used as a reference value for all subsequent measurements of Z in one embodiment. A predetermined change in the value of Z above a given value manifests a tamper event.

The microprocessor 166 may also be programmed to determine if the shackle has been displaced and the amount of displacement after the circuit is armed. The displacement will change the measured resistance of the shackle and thus the change in length of the shackle between the terminals 146' and 146". This change in length can also be used to manifest a tamper condition.

Thus, the integrity of the shackle 6 is monitored by applying the AC current from generator 182 through the shackle portion 6'" at least two different frequencies $f_1$ and $f_2$. The current on line 196 from the ADC 192 is proportional to the complex impedance Z, which in turn is proportional to the (non reactive) resistance R in the shackle and the frequency dependent (reactive) reactance of the capacitances $C_1$ and $C_2$. By using two different frequencies $f_1$ and $f_2$, both R and C can be solved. To handle drift in Z, caused by temperature variation and other long-term drifts, a slow mean value of Z at both frequencies can be measured in one embodiment and stored initially at time of arming the circuit in memory 172. This mean value may be used for comparison in successive measurements as timed by the clock (not shown) programmed into the program of the ROM 168. Depending on the deviation from a preset threshold value, a tamper alarm condition will be trigged.

In the alternative, the temperature sensor 194 can be monitored in another embodiment by the microprocessor 166 and the values compared to a table of values stored in the ROM 168. This is to compensate for possible changes in the value of C between the shackle portion 6'" and the terminals 146' and 146" due to changes in shackle diameter due to predictable temperature shifts. The shackle plastic material exhibits a relatively large expansion as the temperature increases, i.e., a positive temperature coefficient of expansion for the shackle material. A temperature increase thus will correspond to an increase in the value of R for a given length of the shackle 6. The change in R of the shackle due to temperature variations will be dominant due to the large temperature coefficient of the shackle plastic material.

The temperatures can be monitored by the circuit 164, FIG. 18, at specified time intervals. Because the shackle is plastic, its thermal coefficient of expansion may result in variations of the value of C for different sensed temperatures due to changes in the gap with the mating terminal(s) at the terminal-shackle interface due to changes in the shackle diameter as compared to the terminal bore diameter. The initial value of Z, in one embodiment, is determined as a base value at the time the seal 2 is armed. A table is constructed and stored in the ROM 168 representing corrected values of Z (changes in R corresponding to temperature shifts) for this initial value at different ambient temperatures. The microprocessor 166 then reads the corrected value from the ROM corresponding to the current sensed temperature to determine if the value of Z is within acceptable operational limits or whether a tamper event has occurred. The temperature sensor 194, FIG. 18 (not shown on the seal 2), may be located at any convenient location on the body 4 of the seal 2 or elsewhere via a remote tether cable (not shown).

As the resistance of the shackle 6 is highly temperature dependent, including a temperature sensor 194 provides a further safeguard to ensure that a change in the shackle 6 conductivity arises from a change in temperature rather than a tamper event. Further, outside the permissible range of the device, invalid readings may occur due to temperature shifts. By recording if the seal 2 has been exposed to temperature extremes, false alarms can be identified and ignored.

As an optional feature, the temperature sensor 194 can be used to log the ambient temperature over the duration of the shipment of the related goods secured by the seal 2. Resulting values can be stored in the memory 172 and the readings can be used in a later stage for quality assurance issues.

In certain settings, low-frequency interference can be coupled into the shackle 6 portion 6''' and therefore cause invalid readings. By addition of the insulating layer 160 in the strap 158, FIG. 8, the coupling will then be purely capacitive. Given the very low capacitance, the resulting influence from low frequency signals will be substantially reduced.

A set of two LEDs (light emitting diodes) 200, FIG. 18, red and green, red manifesting a tamper event and green manifesting no tamper event and also an armed state, are coupled to the microprocessor 166 which illuminates one of the two diodes depending upon the tamper state of the seal 2. LEDs 200 are mounted on the printed circuit board 140, FIG. 16, and are viewed via the window of plug 72 and opening 70, FIG. 6, to view the status of the tamper state of the seal. A further LED not shown can be used to indicate an armed state and, in the alternative, the Green LED can be used for this purpose. If a tamper condition is sensed by the microprocessor 166, it will activate an alarm condition and issue an optional audio alarm via a speaker in alarm 202 and/or illuminate the red LED of LEDs 200.

In an alternative preferred embodiment, the temperature can be continuously periodically monitored and updated in memory 172 and compared to immediately prior stored measured temperature values. It is assumed in this case that temperature changes will occur gradually in most environments. A filter arrangement can be provided to filter out such gradual changes assumed to be attributed to normal temperature fluctuations. If the measured Z differs from a prior measured value by a significant value beyond a predetermined threshold value representing a rapid transition in the value of Z from a prior measured value, then this would be deemed a tamper event and an alarm given. In this case the algorithm (not shown) uses a sliding mean value with a relatively long time constant to compare relatively fast changes in reading values to determine if a tamper event has occurred. A static reference value as described in the prior embodiment is believed to be less useful in a practical setting.

A small gap is provided between the shackle and a terminal 146' or 146", FIG. 16, the smaller the gap the higher the capacitance. If there is some galvanic connection between the shackle 6 and a terminal, this is acceptable as a pure galvanic connection does not occur in practice. The capacitive coupling between the terminals and the shackle is dominating. It would be difficult to obtain a pure galvanic connection between a metal terminal and a conductive plastic material due to the surface characteristics of the carbon loaded plastic material which may not be purely electrically conductive. By using a capacitive connection between the shackle and terminal(s), the connection problem of a galvanic connection to the conductive plastic is solved. The gap between the terminals and shackle also permits the shackle to be drawn through the slightly larger bores of the terminals 146' and 146" during the locking mode at terminal 146" and assembly of the shackle 6 to the terminal 146', FIG. 16 during initial factory assembly.

Short-range ISM or RFID type of communication using the transceivers 174 and 176 is desired to allow long operating time using small low capacity batteries. The microprocessor 166 comprises a power saving mode and has to be activated prior to usage. The activation is typically performed after the seal shackle 6 has been tightened properly.

In a further embodiment, a designated command together with the current UTC time is sent to the microprocessor 166 over an RFID interface formed by the transceiver 174, which results in a reference measurement of the shackle. This value is used as the initial value for subsequent comparisons and may be reported back to the activating terminal to be used to determine the initial active shackle length. However, this embodiment is optional and not preferred. The initial time is stored in memory 172 and a real time clock (not shown) is enabled. Once initiated, the seal shackle is continuously monitored and any alarm condition together with a timestamp will be stored in non-volatile memory 172, thereby forming an audit trail of real or suspected tamper events.

In FIG. 19, in a different embodiment, a seal 204 is modified form seal 2 of FIG. 1. The seal 204 has a housing body 206 comprising an upper body portion 208 and a lower body portion 210. The two portions are snap fit attached and define an internal cavity 212. Two electrically conductive metal terminals 214, which may be identical to terminal 146, FIG. 17*a*, are attached to a PCB 216 by electrically conductive joints, e.g., solder etc, to PCB conductors 218. The terminals also are situated in and between stanchions 220 on the upper body portion 208 and stanchions 222 in the lower body portion 210 in the cavity 212. A locking clip 224 is secured to the lower body portion at two spaced locations adjacent to the bores of the terminals 214 and stanchions 222. Clip 224 is similar to or identical to clip member 126, FIG. 15. The openings of the clips 224 such as opening 130, FIG. 15, are aligned with the bores of the stanchions 222 and terminals 214.

A shackle 226 which is electrically conductive and may be identical to or similar in construction to shackle 6, FIG. 1, is secured to each clip 224 via the locking tangs of each clip in a one way clutch action similar to that of clip member 126, FIGS. 15 and 16. In this embodiment, the shackle 226 has two free ends 228. The ends 228 are each pulled through a respective one of the terminals 214 and locking clip 224 as shown to secure an article (not shown) to the shackle.

The terminals 214 are capacitively coupled to the shackle as in the embodiment of FIG. 16. The shackle 226 length between the terminals 214 has a resistance R as before. A circuit such as circuit 164, FIG. 18, is on the circuit board 216 as in the embodiment of FIG. 16. Thus a complex impedance Z is formed by the shackle 226 and the terminals 214 as in the prior embodiment. In this embodiment, the shackle is locked to the body 206 independently at each free end, which ends are independently pulled through the terminals 214 and clips 224.

This and the prior embodiment of FIG. 16 exhibit a benefit of not having any galvanic contacts, as in the FIG. 20*a* embodiment, thereby making the seal structures less susceptible to changes electric contact in the locking and connection socket as a result of aging, corrosion, dirt, grease etc. The seal shackle 226 can be made as a simple flexible rod. The operation principle is similar to the previous embodiment of FIG. 16, except that the shackle is now slidable through the seal at both ends independent of each end. This provides a simpler construction than that of FIG. 1. In both embodiments, the seal body is injection molded of thermoplastic and is relatively low cost as is the shackle which makes the entire assembly relatively low cost notwithstanding the cost of the electronic components which also are of mass production and low cost as well.

The seal shackles may be used in an Automatic Identification (AutoID) system based on Radio Frequency Identification (RFID). In a logistics chain such as by ship or rail using cargo containers and the like, where RFID scanners are widely installed to scan passive identity tags, only static information is gathered. If certain items are fitted with an active seal and shackle with an RFID interface and protocol compatible with the infrastructure, these tags can be scanned as well, but only the identity portion of the seal, such as bar code encoded into the seal memory, or other data as desired, is transmitted. The active tags need not be fitted with an additional passive tag, as the scanning system scanning them will scan and report all tags similarly.

For example, in an EPC Generation 2 RFID infrastructure, it can be assumed that the bulk of tags will be simple, low-cost passive tags, known as Class 1 tags. Instead of considering a proportionally smaller number items fitted with active shackle seals (Class 2-4) and treat them differently (thereby adding additional compatibility and implementation difficulties). The active shackle seals of the present embodiments may be designed to respond as Class 1 tags and the strap integrity data then may also be reported additionally as a part of read-write data of further monitoring systems.

In the alternative to a battery, the circuit 164, FIG. 18, may be entirely passive. In this case, the power to operate the circuit 164 is derived from the interrogation device transceiver 176 and no battery is present. In the present seal circuit system, the seal circuit may be semi-passive wherein the battery 144 may be used to operate the seal circuit internal components and actively transmit seal status periodically at more infrequent intervals, e.g., hourly, every few hours, daily etc. This latter situation is regardless of the presence of the transceiver 176 in the vicinity of the circuit 164 or receipt of an interrogation request from transceiver 176. The circuit 164 in the present embodiment is semi-passive in that it wakes up and transmits seal status only when the seal circuit is activated by the reader/transceiver 176. When the circuit wakes up, it then performs all operations to measure Impedance, temperature as applicable and so on to determine the shackle integrity at this time. To conserve power in the battery the somi-passive circuit is preferred. The battery in the present preferred embodiment does not assist in transmission of information, it operates the microprocessor, the LEDs, and monitors the shackle. The power for transmission is part of the operation of the transceivers in an RFID environment. As a result, a smaller battery may be utilized than otherwise required.

Also, the internal real time clock (not shown) provides a time stamp for each monitoring activity of the shackle and stores this information in the memory. The transmitted information includes the time stamp so the reader not only knows that a tamper event occurred but when. Also the LEDs visually communicate the status of the seal at all times when a battery is present or may in the alternative be lit on command or at predetermined intervals as desired for a given implementation.

It will occur to those of ordinary skill that modifications may be made to the disclosed embodiments. For example the seal bodies, the number and configuration of the terminals, the positions and orientation of the terminals and the types, configuration and orientation of the locking devices, and overall configurations may differ from those disclosed herein. The various embodiments disclosed herein are given by way of illustration and not limitation. Such modifications are intended to be included in the scope of the present invention as defined by the appended claims.

What is claimed is:

1. An electronic security seal comprising:

a body;

an elongated electrically conductive shackle;

first and second electrically conductive terminals secured to the body and coupled to the shackle in a shackle locked state wherein the terminals form a complex impedance with the shackle, the impedance manifesting the shackle length between the terminals;

an electrical circuit for measuring the impedance and for indicating a tamper condition; and a locking arrangement for adjustably locking the shackle to the body.

2. The seal of claim 1 wherein at least one of the terminals has a bore for receiving the shackle therethrough.

3. The seal of claim 1 wherein the shackle is electrically conductive plastic.

4. The seal of claim 1 wherein the terminals each have a bore for receiving the shackle therethrough.

5. The seal of claim 1 wherein at least one of the terminals is capacitively coupled to the shackle.

6. The seal of claim 1 wherein the impedance comprises an RC network formed by the capacitance between at least one of the terminals and the shackle and the electrical resistance of the shackle length between the terminals.

7. The seal of claim 1 including an alternating voltage applied to the terminals and to the shackle between the terminals.

8. The seal of claim 1 including a circuit for applying two AC currents at different frequencies to the terminals and the shackle between the terminals.

9. The seal of claim 1 wherein the shackle comprises an electrical insulator surrounding an electrically conductive thermoplastic core.

10. The seal of claim 1 wherein the circuit is arranged for measuring displacement of the shackle relative to the terminals.

11. The seal of claim 1 wherein the circuit includes memory and an arrangement for measuring a first reference impedance value when the shackle is initially locked to the body at both ends and for storing the first value in the memory, the circuit for comparing further measured impedance values to the stored first value to generate a tamper signal when the further value differs from the first value by a predetermined amount.

12. The seal in accordance with claim 1 wherein the circuit is arranged to monitor the integrity of the shackle by periodically measuring the impedance between the first and second terminals including the impedance of the shackle between the first and second terminals.

13. The seal of claim 1 including a radio frequency (RF) transceiver arranged to receive and respond to an external interrogation signal to monitor the tamper state of the shackle.

14. The seal of claim 13 wherein the RF transceiver comprises a transmitter of modulating data employing back-scattering.

15. The seal of claim 1 wherein the shackle is electrically conductive plastic and wherein the shackle first end is molded to a second body, the locking arrangement including a locking member secured to the second body spaced from the shackle first end, and an arrangement for attaching the second body to the first body so that the shackle first end passes through the first body and is locked to the locking member.

16. The seal of claim 15 wherein the shackle second end passes through the first body, through the locking member and through the second body in spaced relation to the first end.

17. The seal of claim 1 wherein the first and second terminals each comprise a cylindrical member having a through bore for receiving the shackle, and galvanically coupled to the circuit.

18. The seal of claim 1 including a second body, the second body having first and second portions hinged to each other, the shackle having a first end attached to the first portion, the locking arrangement including a locking member secured to the second body second portion and spaced from the first portion, the locking member being aligned with the second terminal for receiving a shackle second end therethrough and spaced from the first end for locking the second end thereto, the first terminal for receiving the first end therethrough.

19. The seal of claim 18 wherein the first and second portions overlie one another, the first body having a recess for receiving the second body.

20. The seal of claim 1 including temperature sensor for sensing the ambient temperature, a storage medium for recording the sensed temperature and a transmission circuit for subsequent transmission of the measured impedance and the recorded sensed temperature.

21. The seal of claim 1 wherein the circuit includes memory and an arrangement for measuring an impedance value when the shackle is locked to the body at both ends and for storing the measured impedance value in the memory, the circuit for measuring periodic successive impedance values and updating the stored value with the last of the measured periodic successive impedance values, the circuit for comparing a selected last updated stored measured impedance value to a currently measured impedance value to generate a tamper signal when the current value differs from the last updated stored value by a predetermined amount.

22. The seal of claim 21 wherein the updated values each represents a changing value of a relatively slowly drifting impedance value manifesting changing ambient conditions and a tamper condition manifest a relatively rapid change impedance value.

23. An electronic tamper evident seal comprising:

a locking unit and an electrically conductive shackle having opposing first and second ends;

the locking unit including first and second spaced electrically conductive terminals, the locking unit for locking the shackle first and second ends thereto, the length of the shackle between the terminals manifesting a first impedance, the terminals for receiving and being electrically coupled to the shackle, at least one of the terminals forming a second impedance with the shackle, the first and second impedances forming a complex impedance;

the locking unit including a circuit for measuring the value of the complex impedance, the locking unit being arranged to allow adjustment of the length of the shackle as the shackle is being locked to the locking unit to thereby adjust the value of the complex impedance which manifests the adjusted shackle length.

24. The seal of claim 23 wherein the shackle is conductive thermoplastic material and fixedly secured at the first end to the locking unit and movably secured at the second end to the locking unit for adjustment of the shackle length for locking an article to be secured.

25. The seal of claim 23 wherein the complex impedance comprises an RC network formed by the capacitance between at least one of the terminals and the shackle and the electrical resistance of the shackle length between the terminals.

26. The seal of claim 23 wherein the circuit is arranged to apply an AC signal at least one frequency through the shackle via said terminals, the AC signal being used for measuring the complex impedance.

27. The seal of claim 23 including a control and memory for causing the circuit to measure and store the value of a measured complex impedance in the memory and for periodically subsequently measuring and updating the stored complex impedance with a current measured impedance value and comparing the current measured periodic impedance to the last previously updated stored value, the control for causing the circuit to generate a tamper signal when the compared signals manifest a shackle tampered condition.

28. An electronic tamper evident security seal comprising:

a body;

an elongated electrically conductive shackle having opposite first and second ends;

first and second electrically conductive terminals secured to the body for respectively receiving the first and second ends adjacent thereto, the shackle exhibiting a settable length between the terminals for securing an article thereto, the terminals and the shackle length together forming a complex electrical impedance network having a given value manifesting the shackle set length;

an electronic circuit for measuring the impedance value of the electrical network, for comparing the measured value to a reference value and to generate a signal manifesting the compared measured network value for monitoring the integrity of the shackle; and a locking arrangement for locking the shackle to the body with the shackle electrically coupled to the terminals, the terminals and locking arrangement for permitting the setting of the shackle length according to tightly secure the shackle to an article.

29. The seal of claim 28 wherein the shackle is capacitively coupled to at least one of the terminals.

30. The seal of claim 28 wherein the shackle is capacitively coupled to both of said terminals.

31. The seal of claim 28 wherein the circuit is arranged to apply successive first and second AC signals to the terminals and shackle, each signal at a different frequency and used for measuring the impedance of the network.

32. The seal of claim 28 wherein the shackle is electrically conductive thermoplastic.

* * * * *